US011472526B1

(12) United States Patent
Holley

(10) Patent No.: US 11,472,526 B1
(45) Date of Patent: Oct. 18, 2022

(54) OAR APPARATUS HAVING A PIVOTING OAR BLADE

(71) Applicant: William E. Holley, Tampa, FL (US)

(72) Inventor: William E. Holley, Tampa, FL (US)

( * ) Notice: Subject to any disclaimer, the term of this patent is extended or adjusted under 35 U.S.C. 154(b) by 0 days.

(21) Appl. No.: 17/730,785

(22) Filed: Apr. 27, 2022

Related U.S. Application Data

(63) Continuation of application No. 17/516,081, filed on Nov. 1, 2021, now Pat. No. 11,358,694.

(51) Int. Cl.
*B63H 16/073* (2006.01)
*B63H 16/04* (2006.01)

(52) U.S. Cl.
CPC ..... *B63H 16/04* (2013.01); *B63H 16/073* (2013.01)

(58) Field of Classification Search
CPC ..... B63H 16/04; B63H 2016/043; B63H 2016/046; B63H 16/06; B63H 2016/063; B63H 16/067; B63H 16/073
See application file for complete search history.

(56) References Cited

U.S. PATENT DOCUMENTS 2,424,605 A * 7/1947 Edmonson, Jr. ..... B63H 16/06 440/107
9,376,190 B1 * 6/2016 Horan ..... B63H 16/06
2018/0346084 A1 * 12/2018 Mitchell ..... B63H 16/067

OTHER PUBLICATIONS

Rhode-Szudy, Rob. "Cheap Homemade Oarlocks" Duckworks, https://www.duckworksmagazine.com/05/columns/rob/2/index.htm, indexed Nov. 21, 2005 (Year: 2005).*

* cited by examiner

*Primary Examiner* — Andrew Polay
(74) *Attorney, Agent, or Firm* — Smith & Hopen, P.A.; Andriy Lytvyn

(57) ABSTRACT

An oar apparatus configured to remain submerged under water during the power stroke and the return stroke. The oar apparatus has a sheath and a shaft rotationally disposed within the sheath. An oar blade is affixed to the shaft, such that the oar blade is rotational relative to the sheath. The oar blade has a deployed orientation, in which the oar blade is substantially perpendicular to the movement direction of the vessel, and a feathered configuration, in which the oar blade is substantially parallel to the movement direction of the vessel. The oar blade is asymmetrical relative to the center axis of the shaft, such that resistance of the water exerted onto the oar blade creates a first moment urging the oar blade into the deployed orientation during the power stroke and a second moment urging the oar blade into the feathered orientation on the return stroke.

20 Claims, 7 Drawing Sheets

OAR APPARATUS HAVING A PIVOTING OAR BLADE

PRIORITY CLAIM

This non-provisional patent application is a continuation of and claims priority to a U.S. non-provisional patent application No. 17/516,081 filed on Nov. 1, 2021.

BACKGROUND OF THE INVENTION

1. Field of the Invention

This invention relates to oars. More specifically, it relates to an oar apparatus having a pivoting oar blade configured to remain under water during the power stroke and the return stroke.

2. Brief Description of the Related Art

Water sports, such as kayaking and canoeing, have become a favorite pastime of many people. These water activities involve small vessels that are manually propelled using oars or paddles. Traditional oar designs require the user to submerge the blade of the oar into the water on the power stroke and remove the oar blade out of the water for the return stroke. Although this procedure may appear simple in principle, effective rowing with a traditional oar requires a fair amount of coordination, strength, and properly executed technique.

In an attempt to overcome the disadvantages of the traditional oars, several self-feathering oar designs have been introduced in the past that enable the oar blade to remain submerged underwater during both the power and the return strokes. However, these designs have unresolved flaws. For example, U.S. Pat. No. 3,677,216 discloses an oar with an oar blade that is configured to flip up on the return stroke, while U.S. Pat. Nos. 4,622,017 and 9,511,837 use butterfly-type mechanisms that close two pivoting oar blade portions on the return stroke and open them on the power stroke. Because the oar blades are configured to be submerged underwater for extended period of time complex self-feathering mechanisms involving hinges and springs—such as those taught in the prior art—are prone to malfunction. Thus, what is needed is an improved oar apparatus having an oar blade configured to automatically change orientation as the oar transitions between the power stroke and the return stroke in response to water resistance exerting a force thereon.

SUMMARY OF THE INVENTION

Heretofore unresolved need for an oar apparatus having a reliable self-feathering mechanism is met with a novel and non-obvious invention. In an embodiment, the invention pertains to an oar apparatus for manual propulsion of a vessel. The oar apparatus comprises a sheath having a tubular body, which has an inner lumen. A shaft is rotationally disposed within the lumen of the sheath. The shaft has a first end residing within the lumen of the sheath, and a second end positioned outside the lumen of the sheath. The shaft has a center axis about which the shaft is configured to rotate within the lumen of the sheath. Rotation of the shaft relative to the sheath is restricted to a predefined angular range. In an embodiment, the sheath comprises a circumferential slot and the shaft comprises a pin configured to reside within the slot, such that the length of the slot limits the predefined angular range of rotation of the shaft relative to the sheath.

An oar blade is affixed to the end of the shaft that extends out from the lumen of the sheath. The oar blade has a pivot axis aligned with the center axis of the shaft. The pivot axis conceptually divides the oar blade into a first surface area on a first side of the pivot axis and a second surface area on a second side of the pivot axis, diametrically opposite the first side. The oar blade is asymmetrical with respect to the pivot axis, such that the first surface area of the oar blade is greater than its second surface area.

The oar blade is configured to remain submerged under water during both a power stroke and a return stroke. During the power stroke, the resistance of the water exerts a first moment onto the oar blade, urging the oar blade to rotate about the pivot axis into a deployed orientation, in which the oar blade is substantially perpendicular to a direction of movement of the vessel. The oar blade is immobilized in the deployed orientation for the duration of the power stroke due to the shaft being restricted against rotation relative to the sheath in the direction of the first moment, and the sheath is configured to remain substantially non-rotational. When the rower transitions the oar blade into the return stroke, the first surface area of the oar blade experiences a greater force from the resistance of the water than the second surface area of the oar blade. Thus, the resistance of the water exerts a second moment onto the oar blade, causing the oar blade to rotate into a feathered orientation in which the oar blade is substantially parallel to the direction of movement of the vessel. The oar blade remains in the feathered orientation for the duration of the return stroke.

In an embodiment, the overall length of the oar apparatus is adjustable. In this embodiment, the pin coupled to the sheath may have a first extended position in which the pin resides within the circumferential slot of the sheath, and a second depressed position in which the pin is retracted out of the first slot and into the lumen of the sheath. The sheath may have a plurality of circumferential slots distributed along its tubular body. To adjust the length of the oar apparatus, the user can longitudinally move the shaft relative to the sheath and selectively engage the pin into the circumferential slot corresponding to the desired length of the oar apparatus.

To facilitate the ease of reliable repeated rotation of the shaft within the lumen of the sheath, a layer of lubricant may be disposed at the interface of the shaft and the lumen of the sheath to reduce the coefficients of static and kinetic friction therebetween. Alternatively, one or more bearings can be positioned within the lumen of the sheath to facilitate smooth and low-friction rotation of the shaft relative to the sheath.

Furthermore, the shaft may have diametrically opposed ports configured to receive the pin, such that the oar apparatus can be configured for right-hand or left-hand operation by selectively coupling the pin to the first port or the second port.

In an embodiment, the first surface area of the oar blade may include a bend to facilitate rotation of the oar blade when the resistance of the water is applied thereto, for example when the oar blade transitions from the feathered orientation into the deployed orientation.

The oar apparatus may be connected to the vessel via an oarlock designed to enable the oar apparatus to pivot in a vertical plane.

DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

In the following detailed description of the preferred embodiment, reference is made to the accompanying drawings, which form a part hereof, and within which specific embodiments are shown by way of illustration by which the invention may be practiced. It is to be understood that other embodiments may be utilized, and structural changes may be made without departing from the scope of the invention.

Figure 1A:
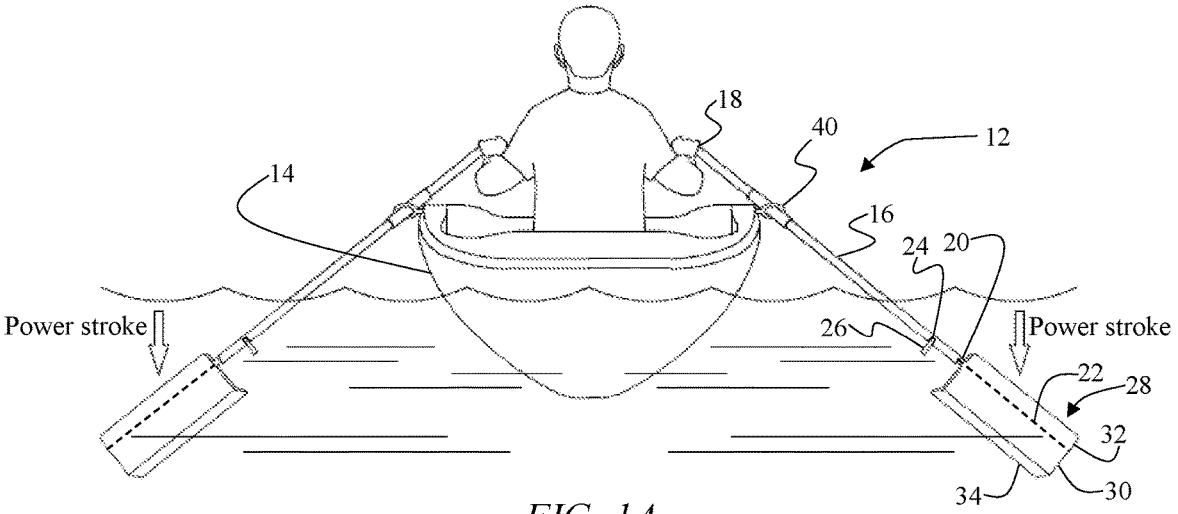
FIG. 1A is a back view of a vessel being propelled by an oar apparatus according to an embodiment of the invention, the view depicts the oar blade in a deployed orientation on a power stroke.
Figure 1B:
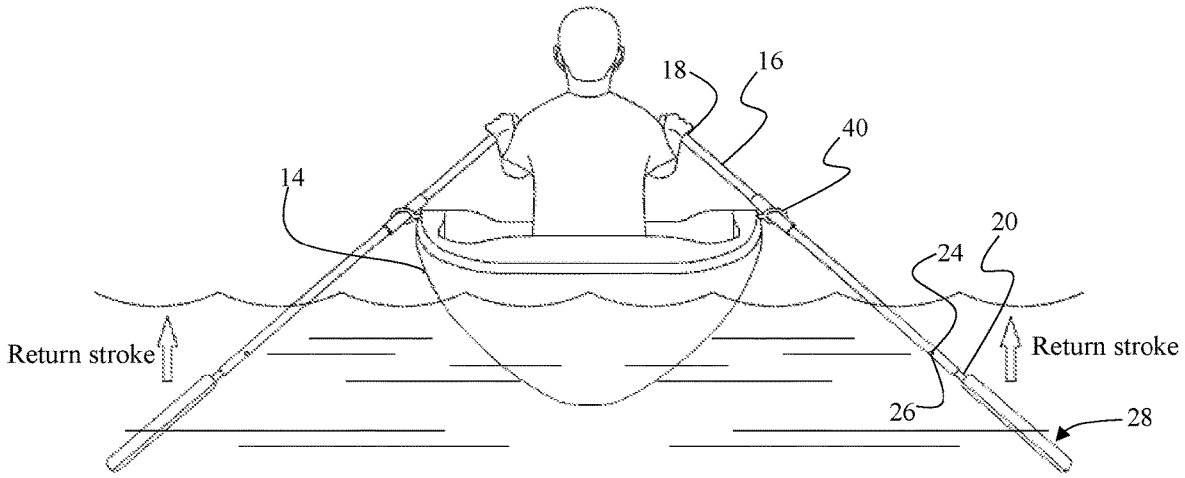
FIG. 1B is a back view of a vessel being propelled by an oar apparatus according to an embodiment of the invention, the view depicts the oar blade in a feathered orientation on a return stroke.

Referring to FIGS. 1A and 1B, an embodiment of the invention pertains to an oar apparatus 12 manually operated by a rower to propel a vessel 14 through the water. The oar apparatus 12 has a sheath 16. Sheath 16 may have a tubular body with an internal lumen. A handle 18 may be disposed on a proximal end of sheath 16 to enable the rower to comfortably hold and operate oar apparatus 12.

Figure 2:
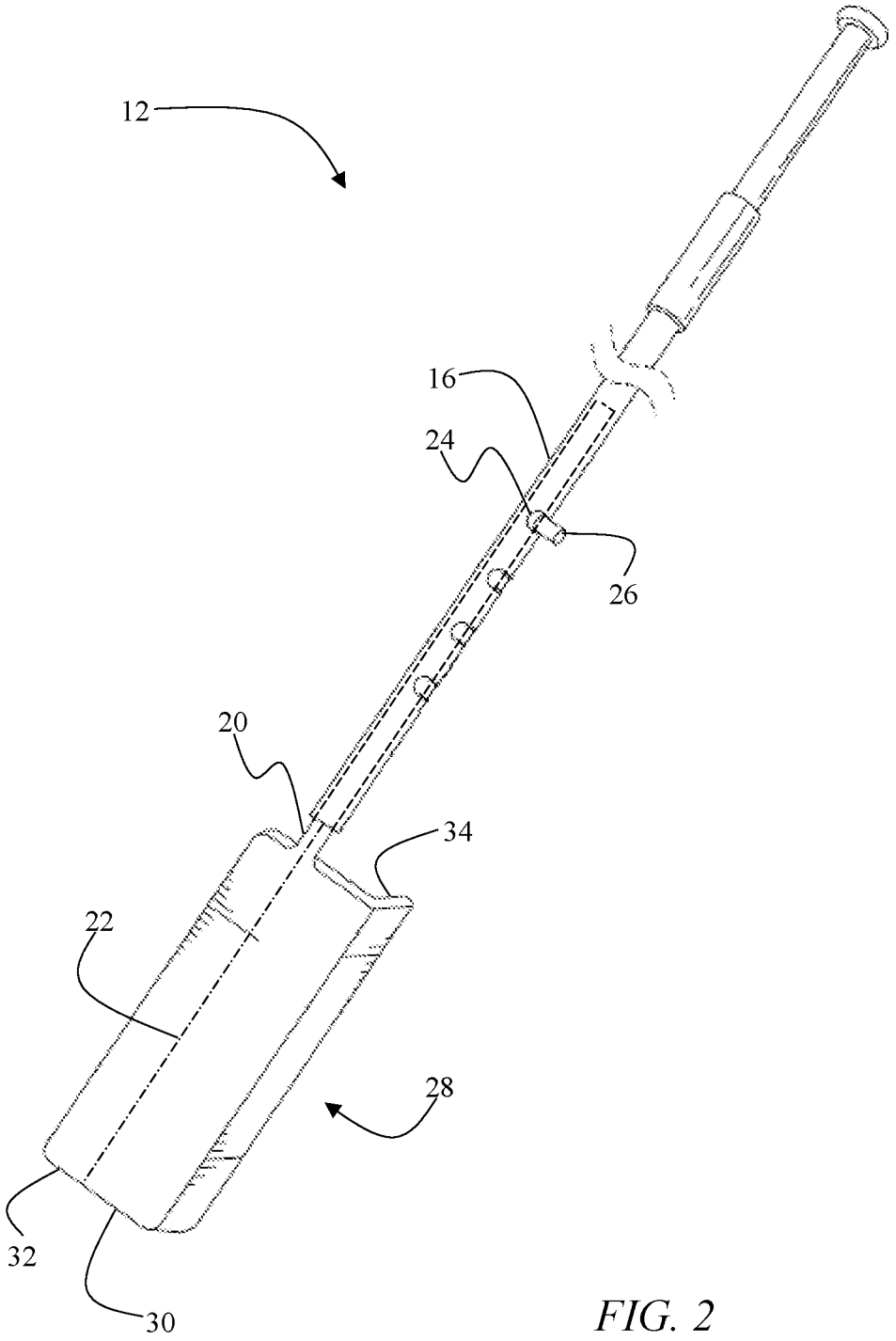
FIG. 2 is a perspective view of an oar apparatus according to an embodiment of the invention.

FIGS. 1A-1B and 2 depict that oar apparatus 12 has a shaft 20 coupled to sheath 16. Shaft 20 may have an elongated cylindrical body. A first end of shaft 20 resides within the lumen of sheath 16 while the second end of shaft 20 resides outside the lumen of sheath 16. Shaft 20 has a center axis 22, wherein shaft 20 is configured to rotate about center axis 22 relative to sheath 16. To facilitate smooth repeated rotation of shaft 20 within the lumen of sheath 16, a layer of lubricant may be disposed therebetween to reduce coefficients of static and kinetic friction. Alternatively, or in addition to, bearings (for example, ball bearings) can be placed into the lumen of sheath 16 to enable shaft 20 to rotate within the lumen of sheath 16 with minimal friction.

The range of angular rotation of shaft 20 relative to sheath 16 is restricted to a predefined angular range, for example 90 degrees. In an embodiment, the mechanism for restricting the range of motion involves a transverse slot 24 circumferentially disposed on sheath 16, depicted in FIG. 2. In an embodiment, shaft 20 has a pin 26 which is configured to reside within slot 24 when the first end of shaft 20 is positioned within the lumen of sheath 16. The circumferential length of slot 24 relative to the circumference of sheath 16 defines the angular range of motion of shaft 20. For example, when shaft 20 rotates in a clockwise direction relative to sheath 16, pin 26 will engage the end of slot 24, thus immobilizing shaft 20 against further rotation in that direction. At this point shaft 20 can only rotate in a counterclockwise direction until pin 26 engages the opposite end of slot 24. In this manner, slot 24 restricts the range of angular rotation of shaft 20 relative sheath 16.

FIG. 2 further depicts an oar blade 28 affixed to the second end of shaft 20. Oar blade 28 is aligned with center axis 22 of shaft 20. Center axis 22 conceptually divides oar blade 28 into a first surface area 30 and a second surface area 32. FIG. 2 further shows that first surface area 30 is greater than second surface area 32. In an embodiment, the width of first surface area 30 accounts for about 62.5% of the total oar blade width, while second surface area 32 accounts for about 37.5% of the total oar blade width. In other embodiments, the relative dimensions of first surface area 30 and second surface area 32 can be different, so long as oar blade 28 is asymmetrical relative center axis 22, such that first surface area 30 is greater than second surface area 32.

Figure 3A:
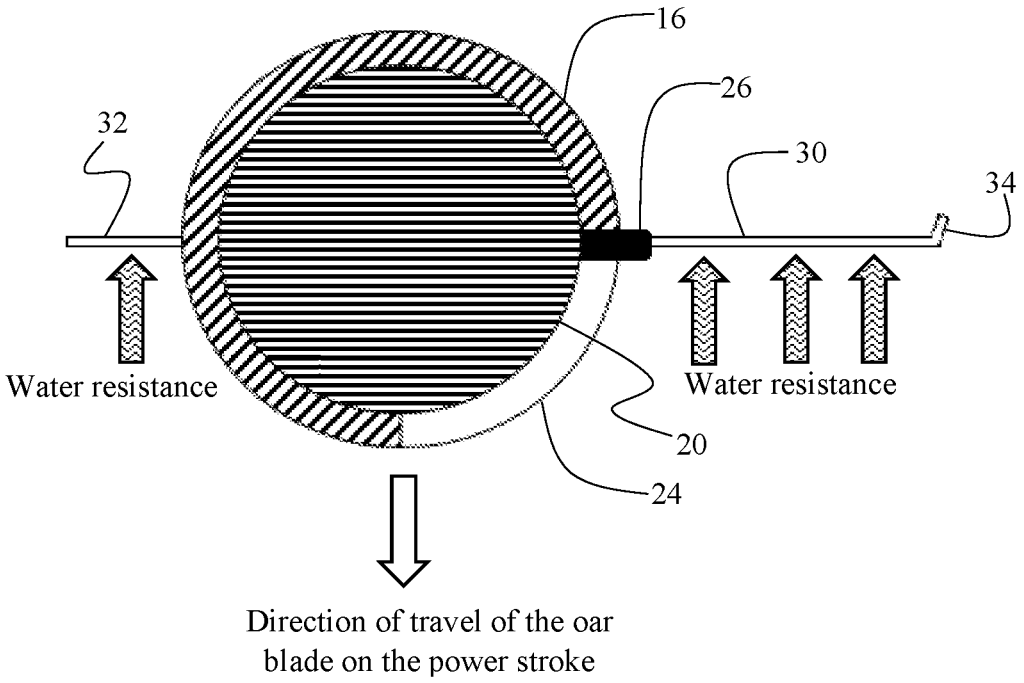
FIG. 3A is a first view in a sequence of seven figures, depicting a cross-sectional top-down view of the oar apparatus showing the oar blade in a deployed orientation during a power stroke.

FIGS. 3A-3G provide a schematic cross-sectional view depicting transitioning of oar blade 28 from a deployed orientation on the power stroke (also depicted in FIG. 1A) to a feathered orientation on the return stroke (also depicted in FIG. 1B) and back to the deployed orientation for the subsequent power stroke. FIG. 3A depicts that, during the power stroke, oar blade 28 is oriented substantially perpendicularly to the movement vector of vessel 14. As the rower applies a force onto handle 18 of sheath 16, oar blade 28 pushes through the water, propelling vessel 14 forward. Because first surface area 30 is greater than second surface area 32, first surface area 30 experiences a greater amount of force exerted by the water resistance than second surface area 32. As a result, the water resistance exerts a moment (in the counterclockwise direction in FIG. 3A) onto oar blade 28, causing oar blade 28 to rotate about center axis 22 into deployed configuration depicted in FIG. 3A (also depicted in FIG. 1A). Because movement of pin 26 is constricted within slot 24, oar blade 28 cannot rotate in the counterclockwise direction past the deployed configuration depicted in FIG. 3A.

Figure 3B:
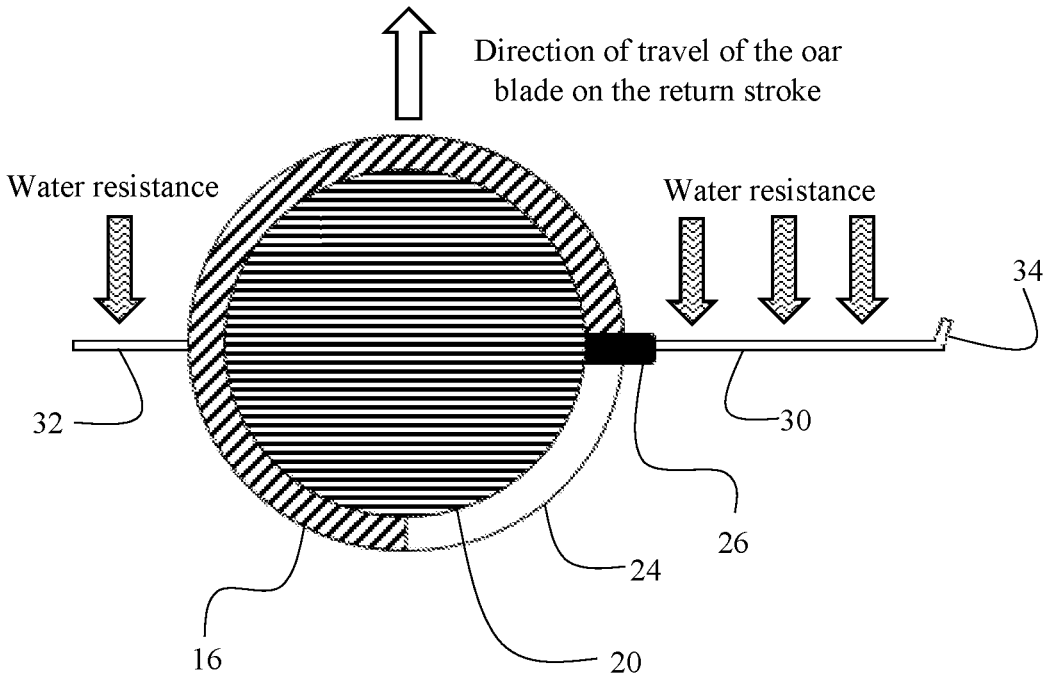
FIG. 3B is a second view in the sequence, depicting the cross-sectional top-down view of the oar apparatus immediately after a rower reverses the direction of force applied onto the oar apparatus to transition from a power stroke to a return stroke.
Figure 3C:
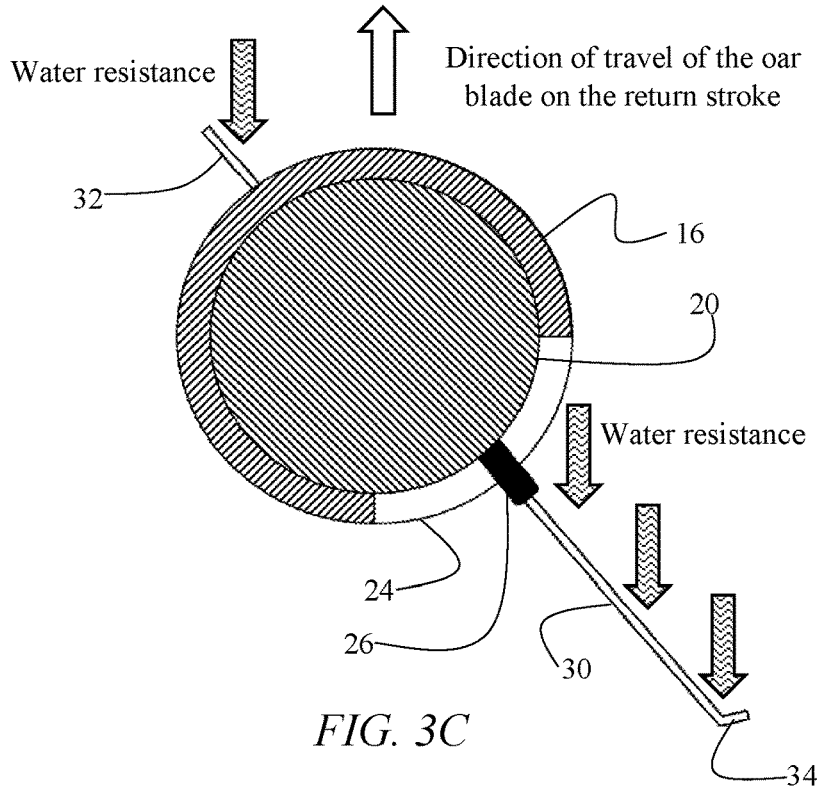
FIG. 3C is a third view in the sequence, depicting the cross-sectional top-down view of the oar apparatus at a beginning of the return stroke showing the oar blade transitioning from a deployed orientation into a feathered orientation.
Figure 3D:
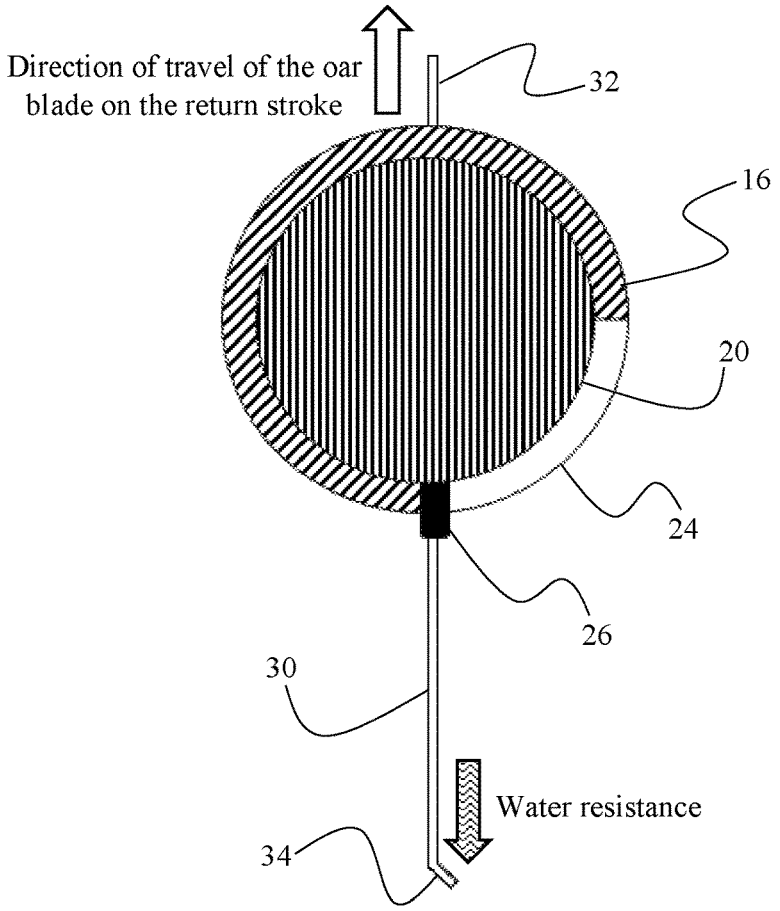
FIG. 3D is a fourth view in the sequence, depicting the cross-sectional top-down view of the oar apparatus when the oar blade is in the feather orientation on the return stroke.
Figure 3E:
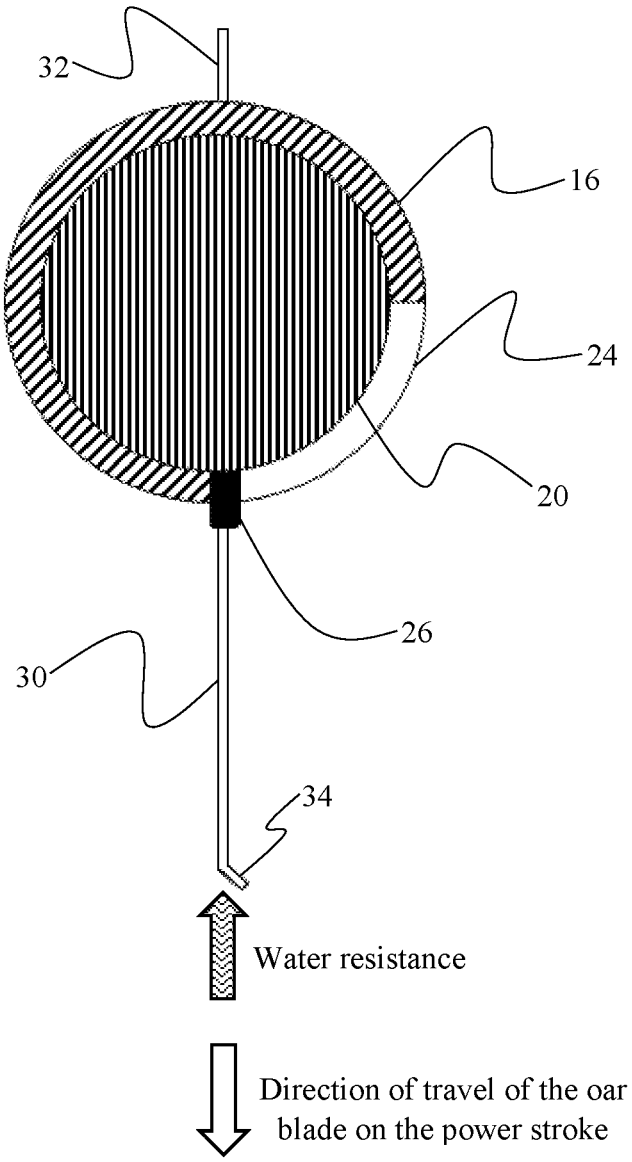
FIG. 3E is a fifth view in the sequence, depicting the cross-sectional top-down view of the oar apparatus immediately after a rower reverses the direction of force applied onto the oar apparatus to transition from the return stroke to a subsequent power stroke.
Figure 3F:
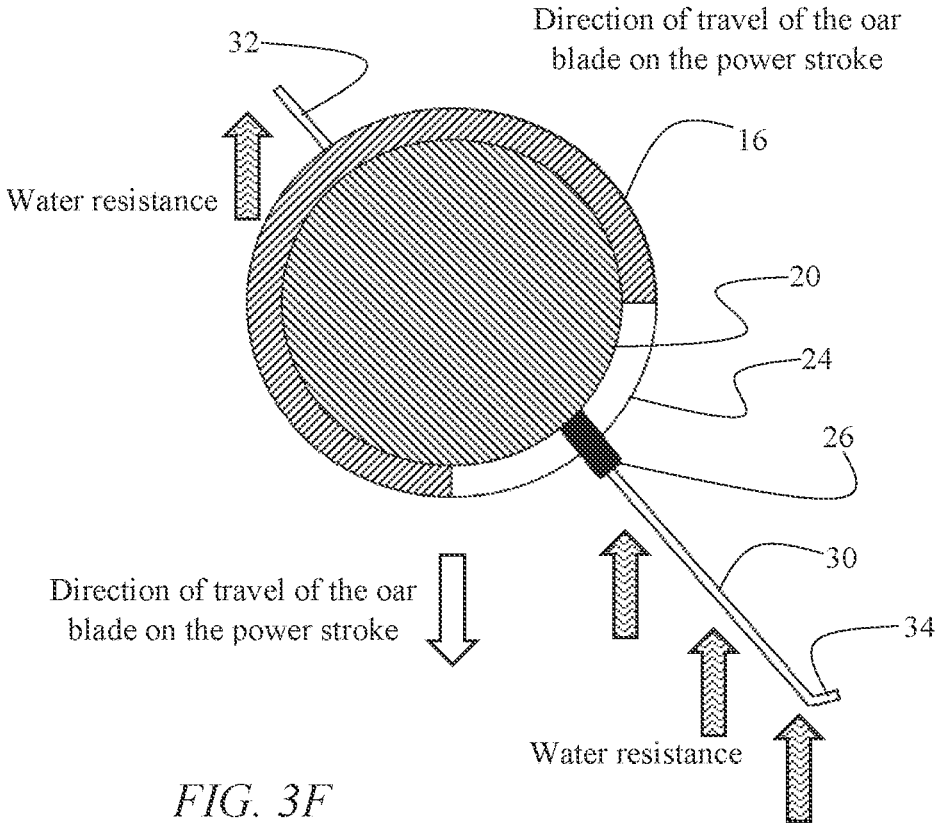
FIG. 3F is a sixth view in the sequence, depicting the cross-sectional top-down view of the oar apparatus at the beginning of the power stroke as the water resistance is causing the oar blade to pivot from a feathered orientation into a deployed orientation.
Figure 3G:
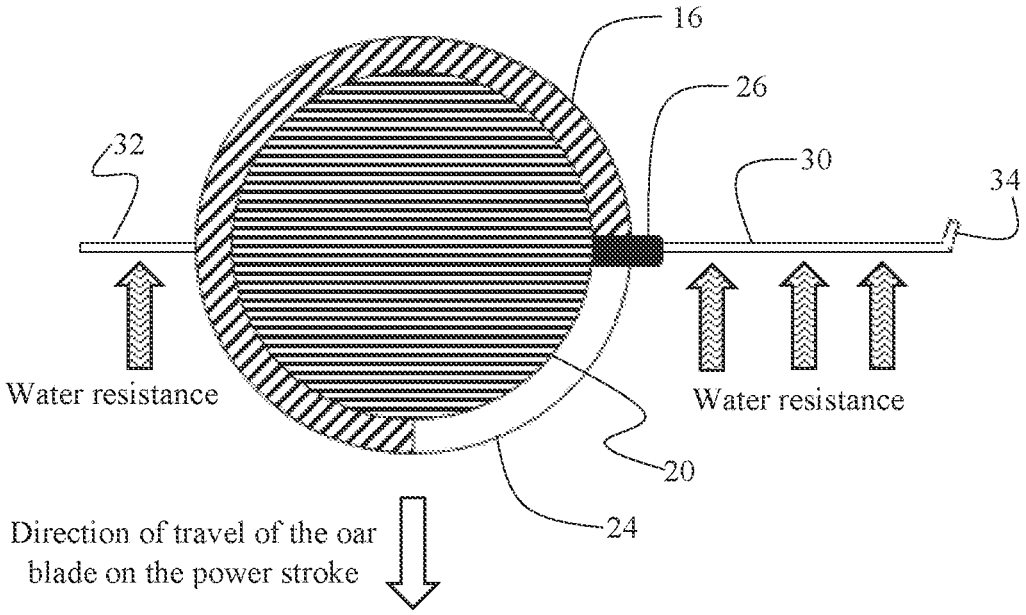
FIG. 3G is a seventh view in the sequence, depicting the cross-sectional top-down view of the oar apparatus with the oar blade in the deployed position for the power stroke.

Next, FIG. 3B depicts that, when the rower reverses the force applied onto handle 18 of shaft 20, the force exerted by the water resistance onto oar blade 28 becomes reversed. FIG. 3B depicts, that due to asymmetrical configuration of oar blade 28, the force of water resistance exerted onto first surface area 30 is greater than the force of water resistance exerted onto second surface area 32. FIG. 3C shows that this uneven force distribution on oar blade 28 creates a moment (in a clockwise direction) that rotates oar blade 28 and shaft 20 relative to sheath 16, causing pin 26 to move within slot 24. FIG. 3D depicts oar blade 28 transitioned into a feathered orientation, which is substantially parallel to the movement vector of vessel 14. Because only the leading edge of oar blade 28 exerts a force onto the water, the return stroke requires minimal effort from the rower and does not substantially effect the movement of the vessel.

FIG. 1E depicts that, when the rower initiates the next power stroke, the water resistance exerts a force onto oar blade 28. FIG. 1F shows that this force results in a moment that urges oar blade 28 to rotate toward its deployed orientation, in which oar blade 28 is substantially perpendicular to the direction of movement of vessel 14. FIG. 1G depicts that, in the deployed configuration, pin 26 engages the end of slot 24, thereby preventing oar blade 28 from rotating further, thus immobilizing oar blade 28 in the deployed configuration for the duration of the power stroke. Upon initiation of the return stroke, the moment exerted by the water onto oar blade 28 reverses again, causing oar blade 28 and shaft 20 to rotate about center axis 22 of shaft 20. As shaft 20 rotates within lumen 18 of sheath 16, pin 26 slides within slot 24 until pin 26 engages the opposite end of slot 24. At this point, oar blade 28 will be in its feathered configuration, in which oar blade 28 remains for the duration of the return stroke. When the rower initiates the next power stroke, oar blade 28 rotates into its deployed orientation yet again, and the process continues, with each power stroke propelling vessel 14 forward.

FIGS. 1-3 depict that, oar blade 28 may have one or more bends 34 to increase the moment exerted by the water onto oar blade 28. FIGS. 3E and 3F depict that the trailing edge of first surface area 30 has a bend 34, which increases the moment exerted by the water onto oar blade 28 when oar apparatus 12 is transitioned between the return stroke and the power stroke. In this manner, during the return stroke the force exerted onto bend 34 by the water column urges oar blade 28 to rotate into its deployed orientation.

FIG. 2 depicts that sheath 16 may have multiple transverse slots 24 distributed therealong. This feature enables the user to adjust the length of oar apparatus 12 by disengaging pin 26 from one slot 24 and then, reengaging pin 26 into another slot 24, positioned above or below the original slot 24. In this manner, the user can adjust the length of oar apparatus 12 by controlling the length of shaft 20 that resides within lumen 18 of sheath 16. In an embodiment, pin 26 may have a biasing mechanism associated therewith, such that the user can depress pin 26 against the biasing force causing pin 26 to enter lumen 18 of sheath 16. The user can then longitudinally slide shaft 20 relative to sheath 16, and the biasing force will transition pin 26 into an extended configuration when pin 26 arrives at a desired slot 24.

In an embodiment, shaft 20 may be equipped with diametrically opposite ports into which pin 26 can be coupled. In this manner, oar apparatus 12 can be adjusted for left-hand or right-hand operation by simply coupling pin 26 to a corresponding port within shaft 20. This feature simplifies the manufacturing process because both left-hand and right-hand oar apparatuses 12 can be structured identically and the right-hand versus left-hand configuration can be selected by the user.

Figure 4:
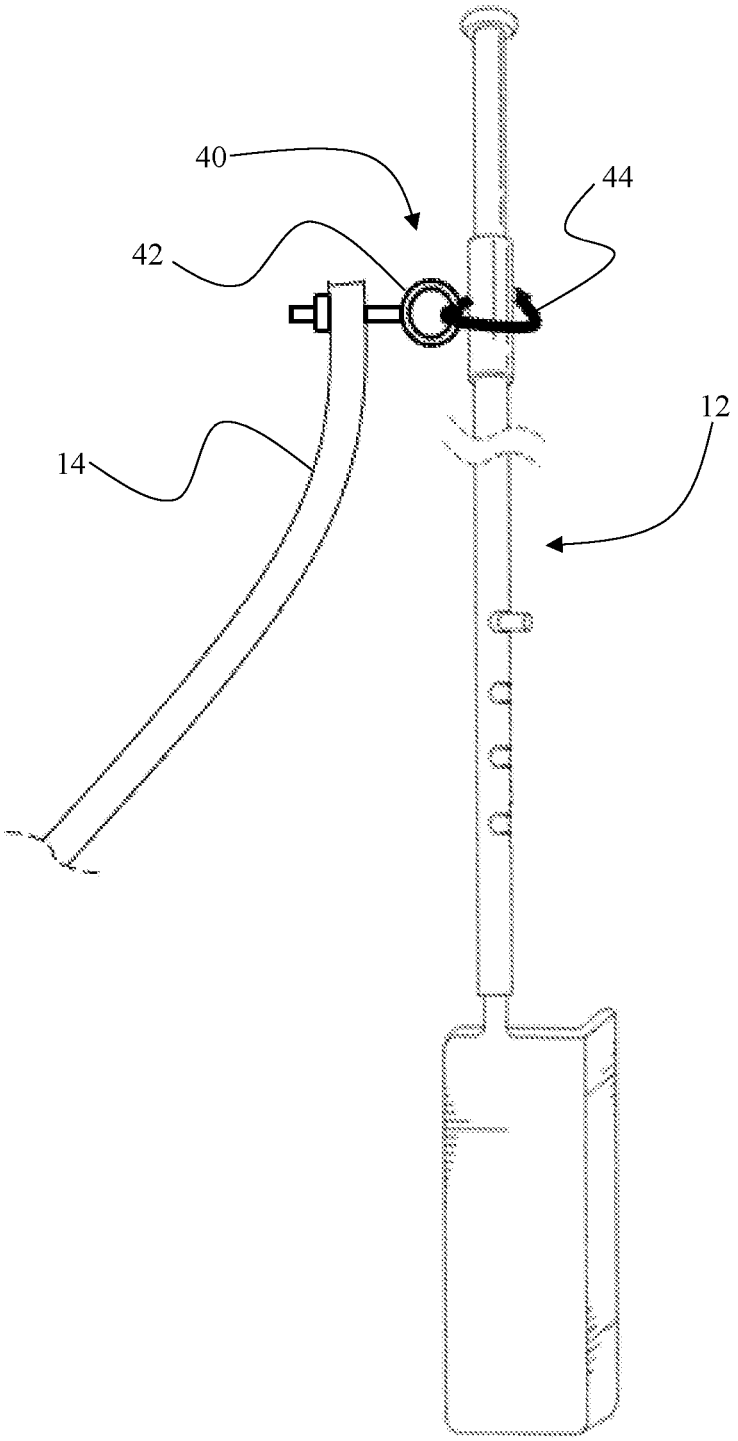
FIG. 4 is a schematic view depicting an oarlock according to an embodiment of the invention.

Another aspect of the invention pertains to an innovative oarlock 40 depicted in FIG. 4. Oarlock 40 comprises an eye bolt 42 mounted to a side of vessel 14. Oar apparatus 12 can be coupled to oarlock 40 by using a zip-tie 44 or another coupling device to securely attach sheath 16 to eyebolt 42. Oarlock 40 enables the rower to easily operate oar apparatus 12 by simply moving handle 18 attached to sheath 16 back-and-forth in a linear motion.

As a result of the innovative features disclosed above, effective operation of oar apparatus 12 requires less skill and training relative to traditional oars. Oar blade 28 of oar apparatus 12 can be immersed in the water during power strokes and return strokes, such that vessel 14 can be propelled forward with a simple fore-to-aft and aft-to-fore movement of handle 18 of oar apparatus 12. Oar apparatus 12 is also more efficient than traditional oars because it is configured to be used in the most effective center porition of the power stoke, whereas traditional oars require a full range of motion during the power stroke, including the parts of the power stroke when the oar blade enters and exits the water, during which the oar blade moves vertically, instead of horizontally, thus wasting energy and providing little propulsion. The innovative oarlock 40 enables oar apparatus 12 to be used vertically, allowing the rower to change the fulcrum point and thus, the leverage of oar apparatus 12.

Furthermore, canoeists often use a "J" stroke—which is a brief stroke ninety degrees from the power stroke, and away from vessel 14. The J-stroke is often used at the end of the power stroke to counter the movement of the bow of vessel 14 to the side opposite the side at which the oar is located. This technique enables the rower to paddle on one side of vessel 14 and propel vessel 14 in a straight line. Another advantage of oar apparatus 12 disclosed herein can be effectively used for the J-stroke.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense. The term "substantially" as used herein means +/−30 degrees of the nominal direction.

What is claimed is:

1. An oarlock configured to operationally couple a self-feathering oar apparatus for manual propulsion of a vessel to the vessel, comprising:

an eyebolt attached to the vessel, the eyebolt having an aperture;

a coupling device passing through the aperture of the eyebolt and at least partially encircling a tubular sheath of the self-feathering oar apparatus thereby coupling the tubular sheath to the eyebolt, wherein the coupling device enables the tubular sheath to pivot in a vertical plane and to translate longitudinally along a center axis thereof relative to the eyebolt;

wherein the self-feathering oar apparatus comprises a shaft rotationally disposed within a lumen of the tubular sheath, the shaft configured to rotate about a center axis thereof within the lumen of the sheath, and wherein an oar blade is affixed to a second end of the shaft; and wherein the oarlock creates a pivot point for the tubular sheath of the self-feathering oar apparatus such that the tubular sheath is configured to pivot in the vertical plane responsive to a manual force being applied onto a handle of the self-feathering oar apparatus, whereby the oar blade is configured to transition between a deployed configuration on a power stroke and a feathered configuration on a return stroke, wherein the oar blade is configured to remain submerged under water during the power stroke and the return stroke.

2. The oarlock of claim 1, wherein an angle of rotation of the shaft relative to the tubular sheath is restricted to a predefined angular range.

3. The oarlock of claim 1, wherein the oar blade is asymmetrical relative to the center axis of the tubular sheath.

4. The oarlock of claim 1, wherein during the power stroke resistance of the water exerts a first moment onto the oar blade urging the oar blade to axially rotate into a deployed orientation in which the oar blade is substantially perpendicular to a direction of movement of the vessel, wherein the oar blade is immobilized in the deployed orientation for duration of the power stroke due to the shaft being restricted against rotation relative to the tubular sheath in the direction of the first moment, wherein the tubular sheath is configured to remain substantially non-rotational during the power stroke.

5. The oarlock of claim 1, wherein during the return stroke, resistance of water exerts a second moment onto the oar blade causing the oar blade to rotate into a feathered orientation in which the oar blade is substantially parallel to the direction of movement of the vessel.

6. The oar apparatus of claim 1, wherein the tubular sheath comprises a first slot and the shaft comprises a pin configured to reside within the first slot, wherein a circumferential length of the first slot defines an angular range of rotation of the shaft relative to the tubular sheath.

7. The oar apparatus of claim 6, wherein the pin has a first extended position in which the pin resides within the first slot and a second depressed position in which the pin is retracted out of the first slot.

8. The oar apparatus of claim 7, wherein an overall length of the oar apparatus is adjustable by longitudinally translating the shaft relative to the tubular sheath and selectively engaging the pin into one of a plurality of slots disposes along the tubular sheath.

9. The oar apparatus of claim 1, further comprising a lubricant disposed at an interface of the shaft and the lumen of the tubular sheath.

10. The oar apparatus of claim 1, further comprising a bearing disposed within the lumen of the tubular sheath and configured to facilitate rotation of the shaft relative to the tubular sheath.

11. The oar apparatus of claim 1, wherein the tubular shaft comprises a first port and a second port configured to receive the pin, whereby the oar apparatus can be configured for right-hand or left-hand operation by selectively coupling the pin to the first port or the second port.

12. The oar apparatus of claim 1, wherein the oar blade has a bend configured to facilitate rotation of the oar blade between the deployed orientation and the feathered orientation.

13. The oar apparatus of claim 1, wherein the coupling device is a tie or a clamp.

14. The oar apparatus of claim 1, wherein the oarlock is transversally disposed on an exterior surface of a hull of the vessel.

15. A method of using an oarlock and self-feathering oar apparatus for manual propulsion of a vessel, comprising:

providing an oarlock transversally affixed to an exterior surface of a hull of the vessel;

coupling a sheath of the oarlock to the oarlock using a coupling device, wherein the coupling device enables the tubular sheath to pivot in a vertical plane and to translate longitudinally along a center axis thereof relative to the eyebolt, wherein the sheath has a handle end configured to be grasped by a user and a lumen rotationally receiving a shaft;

applying a first force onto the handle of sheath in a first direction substantially opposite to a direction of travel of the vessel, the first force causing the sheath to pivot in a vertical plane about a pivot point created by the oarlock, wherein water resistance exerted onto an oar blade coupled to the shaft causes the shaft to axially rotate in a first axial direction within the lumen of the sheath, thereby transitioning the oar blade into a deployed orientation; and applying a second force onto the handle of sheath in a second direction substantially aligned with a direction of travel of the vessel, the second force causing the sheath to pivot in the vertical plane about the pivot point created by the oarlock, wherein water resistance exerted onto the oar blade causes the shaft to axially rotate in the second axial direction, opposite the first axial direction, within the lumen of the sheath, thereby transitioning the oar blade into a feathered orientation.

16. The method of claim 15, wherein an angle of rotation of the shaft relative to the sheath is restricted to a predefined angular range.

17. The method of claim 15, wherein the oar blade is asymmetrical relative to the center axis of the sheath.

18. The method of claim 15, wherein the oar blade has a bend configured to facilitate rotation of the oar blade between the deployed orientation and the feathered orientation.

19. The method of claim 15, wherein the oarlock comprises an eyelet fastened to the hull of the vessel.

20. The method of claim 15, wherein the coupling device is a tie or a clamp configured to connect the sheath of the self-feathering oar apparatus to an aperture of the eyelet, thereby enabling the sheath to pivot about the eyelet in a vertical plane.

* * * * *